US008002084B2

(12) United States Patent
Huang

(10) Patent No.: US 8,002,084 B2
(45) Date of Patent: Aug. 23, 2011

(54) STEPLADDER

(76) Inventor: Chin Yin Huang, Taipei Hsien (TW)

( * ) Notice: Subject to any disclaimer, the term of this patent is extended or adjusted under 35 U.S.C. 154(b) by 218 days.

(21) Appl. No.: 12/406,270

(22) Filed: Mar. 18, 2009

(65) Prior Publication Data

US 2010/0236866 A1 Sep. 23, 2010

(51) Int. Cl.
*E06C 1/24* (2006.01)

(52) U.S. Cl. ..... 182/161; 159/165; 159/180.1

(58) Field of Classification Search ..... 182/156, 182/159, 161, 165, 180.1, 26
See application file for complete search history.

(56) References Cited

U.S. PATENT DOCUMENTS 6,012,548 A * 1/2000 Kim ..... 182/165
6,427,805 B1 * 8/2002 Gibson et al. ..... 182/165
6,550,579 B2 * 4/2003 Gibson et al. ..... 182/161
7,182,176 B2 * 2/2007 Gibson et al. ..... 182/129
7,849,967 B2 * 12/2010 Gibson et al. ..... 182/176

* cited by examiner

*Primary Examiner* — Alvin C Chin-Shue
*Assistant Examiner* — Daniel Cahn
(74) *Attorney, Agent, or Firm* — Alan Kamrath; Kamrath & Associates PA

(57) ABSTRACT

A stepladder has a front frame, a rear frame, a bracket and multiple steps. The front frame has two front side rails and multiple rungs mounted between the front side rails. The rear frame is connected pivotally to the front frame and has two rear side rails, a crossbeam and a lock. The lock is mounted pivotally on the crossbeam. The bracket is connected pivotally and slidably to the rear frame and has multiple pivot pins. The steps are mounted pivotally on the bracket and are selectively and engaged respectively with the rungs of the front frame. The lock selectively hooks a pivot pin to stably lock the bracket for improved safety.

3 Claims, 9 Drawing Sheets

STEPLADDER

BACKGROUND OF THE INVENTION

1. Field of the Invention

The present invention relates to a ladder and more particularly, to a stepladder that has a lock to maintain the stepladder extended without inadvertently folding.

2. Description of Related Art

A conventional stepladder may fold and extend and has a front frame, a rear frame, a bracket and multiple steps. The rear frame is mounted pivotally on the front frame. The bracket is mounted movably on the rear frame. The steps are mounted pivotally on the bracket support and the front frame. However, the stepladder has no locking device to hold itself stably in an extended configuration so inadvertent folding may occur when the stepladder suffers external impacts or people on the stepladder move up and down. Therefore, a user standing onto the stepladder may be injured due to the inadvertent folding of the stepladder.

To overcome the shortcomings, the present invention provides a stepladder to mitigate or obviate the aforementioned problems.

SUMMARY OF THE INVENTION

The main objective of the invention is to provide a stepladder that has a lock to maintain the stepladder in an extended configuration without inadvertently folding.

A stepladder has a front frame, a rear frame, a bracket and multiple steps. The front frame has two front side rails and multiple rungs mounted between the front side rails. The rear frame is connected pivotally to the front frame and has two rear side rails, a crossbeam and a lock. The lock is mounted pivotally on the crossbeam. The bracket is connected pivotally and slidably to the rear frame and has multiple pivot pins. The steps are mounted pivotally on the bracket and are selectively engaged respectively with the rungs of the front frame. The lock selectively hooks on one pivot pin to stably lock a pin of the bracket to stably lock the bracket for improved safety.

Other objectives, advantages and novel features of the invention will become more apparent from the following detailed description when taken in conjunction with the accompanying drawings.

DETAILED DESCRIPTION OF THE PREFERRED EMBODIMENT

Figure 1:
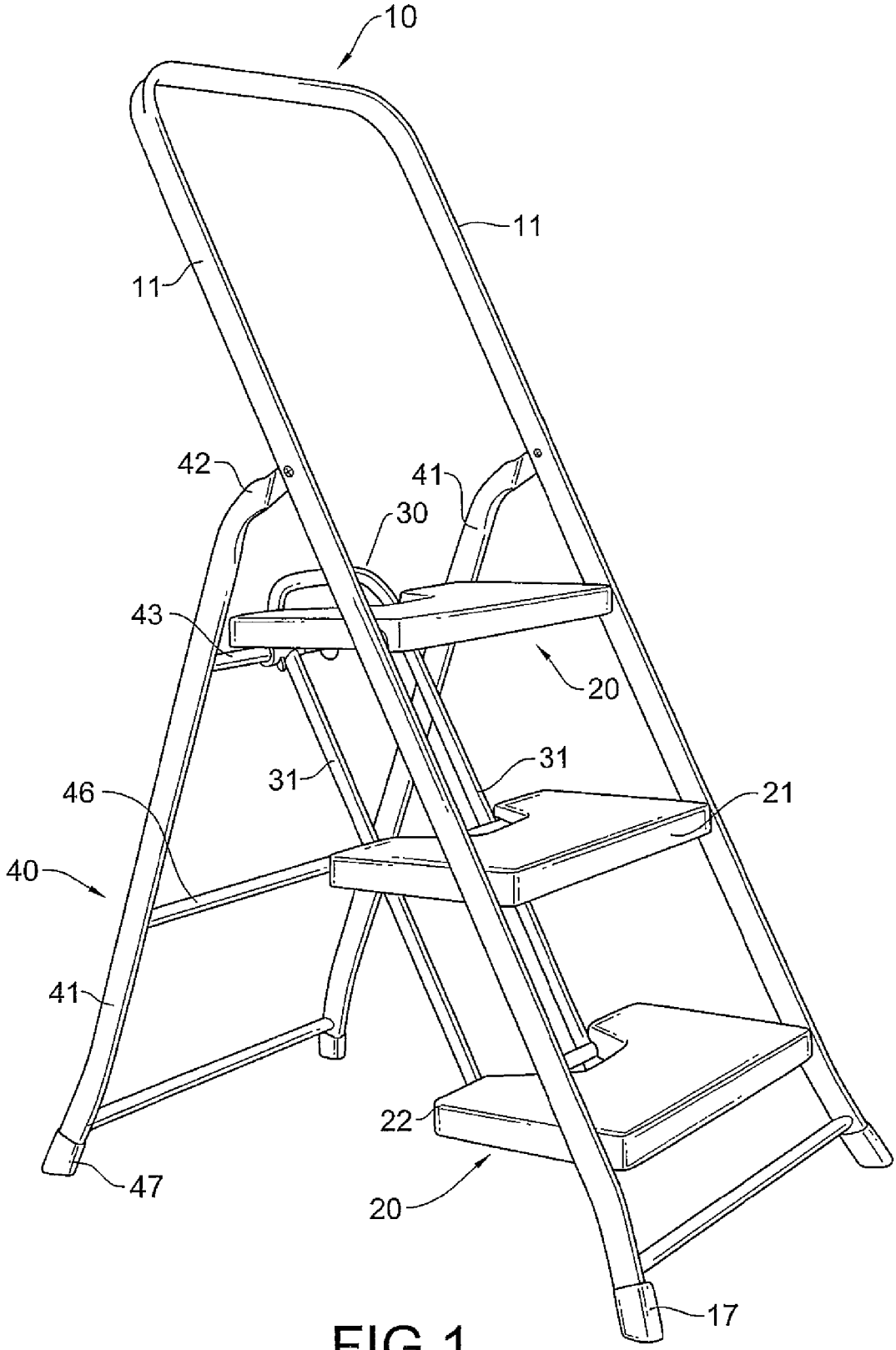
FIG. 1 is a perspective view of a stepladder in accordance with the present invention.
Figure 2:
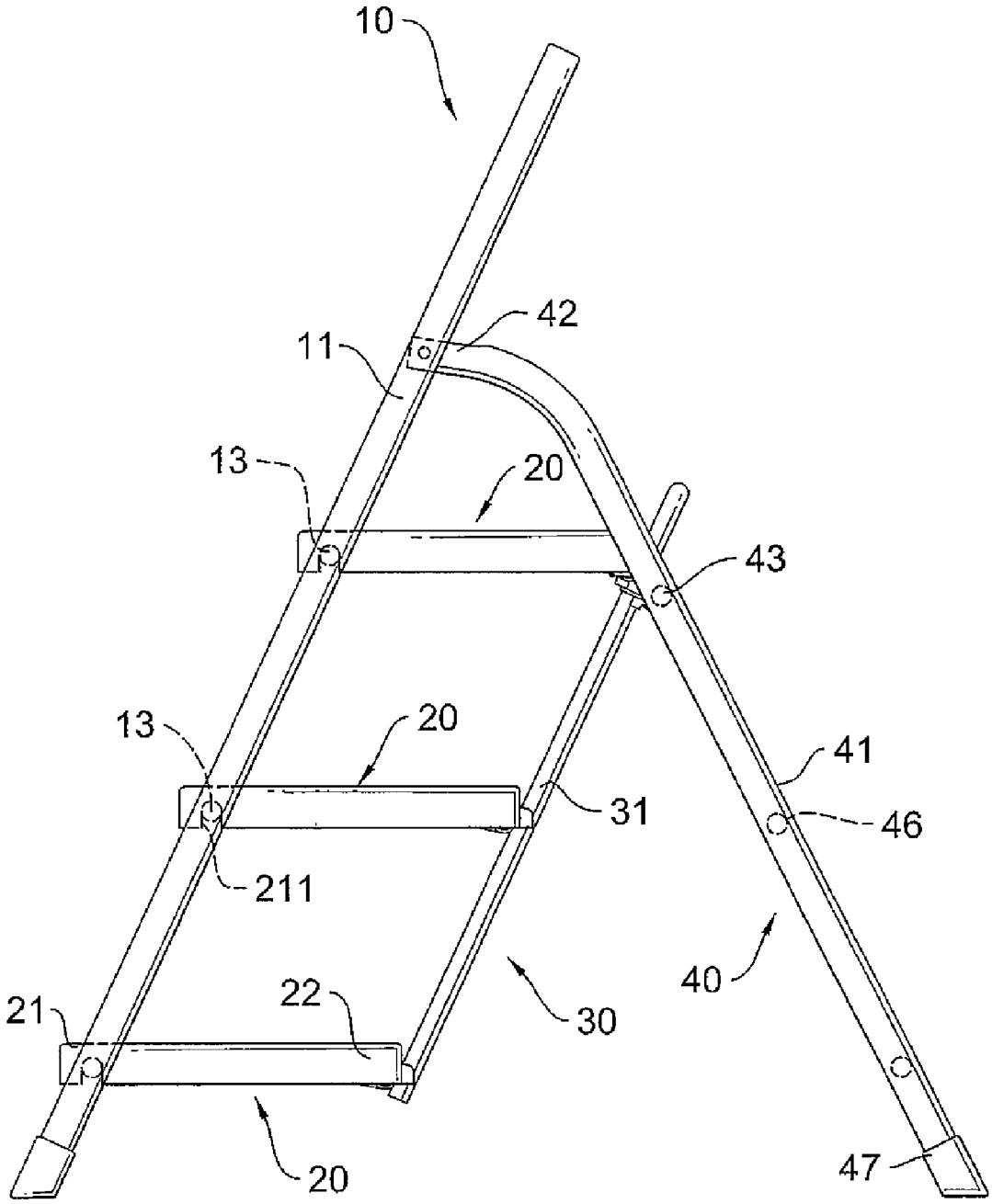
FIG. 2 is a side view of the stepladder in FIG. 1.
Figure 3:
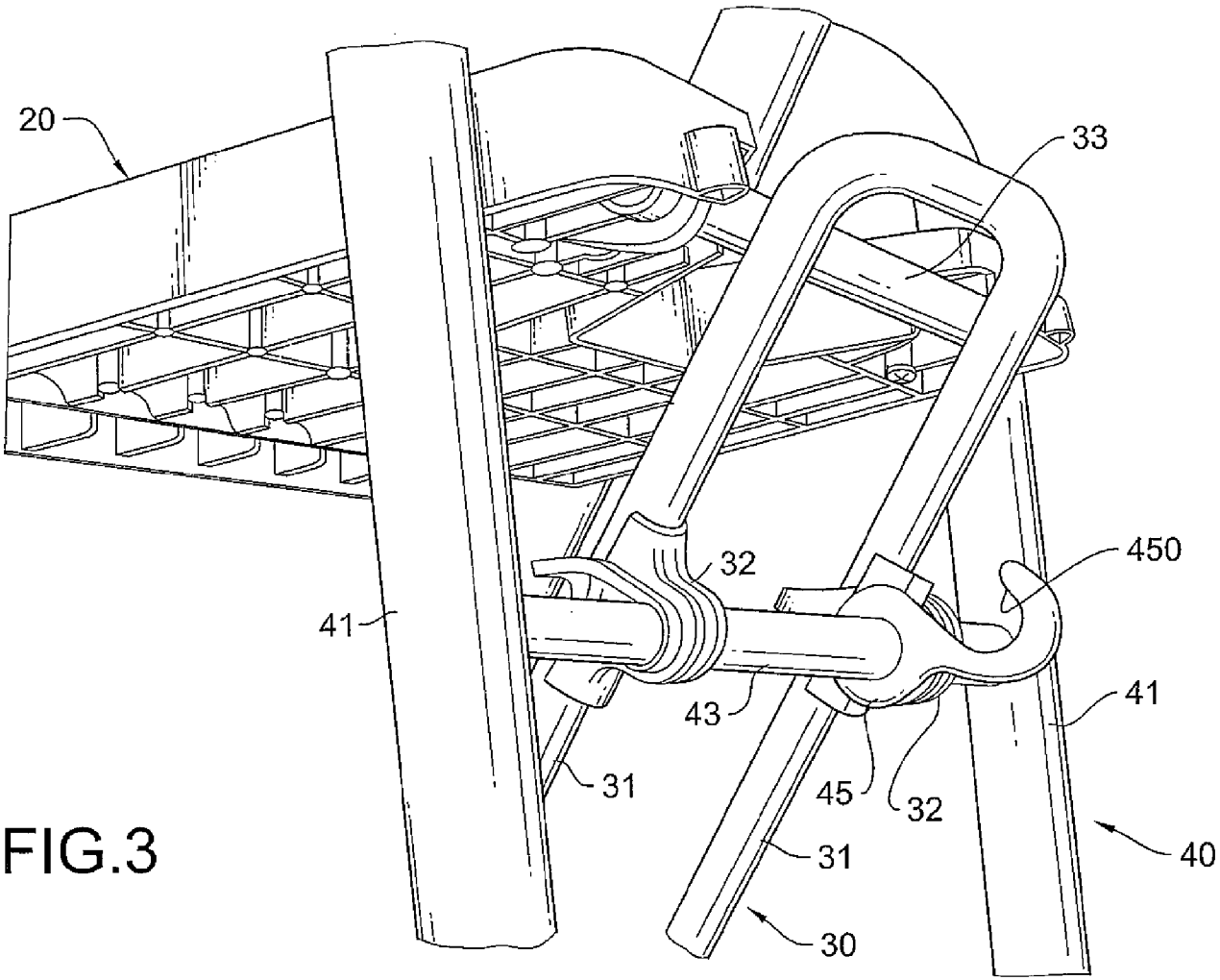
FIG. 3 is an enlarged rear perspective view of the stepladder in FIG. 1.

With reference to FIGS. 1 to 3, a stepladder in accordance with the present invention comprises a front frame (10), a rear frame (40), a bracket (30) and multiple steps (20).

The front frame (10) may be U-shaped and has two front side rails (11) and multiple rungs (13). The front side rails (11) are parallel to each other and each front side rail (11) has a bottom end (17). The rungs (13) are mounted transversely between the front side rails (11) at intervals.

The rear frame (40) is connected pivotally to the front frame (10), has two rear side rails (41), a crossbeam (43) and a lock (45) and may further have multiple supporting beams (46).

The rear side rails (41) correspond respectively to the front side rails (11) and are parallel to each other. Each rear side rail (41) has a top end (42) and a bottom end (47). The top end (42) of the rear side rail (41) is mounted pivotally on a corresponding front side rail (11).

The crossbeam (43) is mounted transversely between the rear side rails (41).

The lock (45) is mounted pivotally on the crossbeam (43) and has a hook (450) formed on the lock (45).

The supporting beams (46) are mounted between the rear side rails (41) to hold the rear side rails (41) securely.

The bracket (30) may be U-shaped, is connected pivotally and slidably to the rear frame (40) and has two bars (31), two pivot slides (32) and multiple pivot pins (33).

The bars (31) are parallel to each other.

The pivot slides (32) are slidably mounted respectively on the bars (31) of the bracket (30) and are mounted pivotally on the crossbeam (43) of the rear frame (40).

Figure 4:
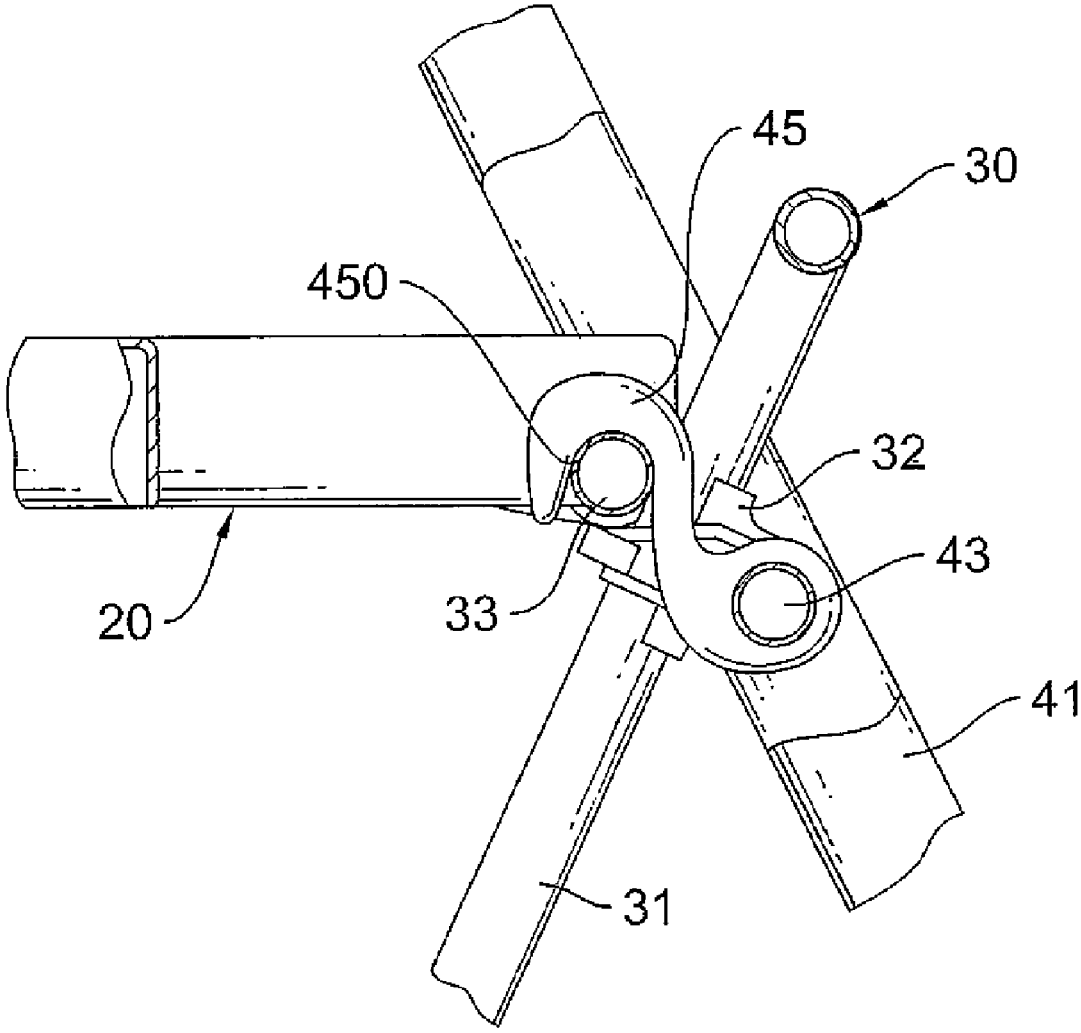
FIG. 4 is an enlarged side view of the stepladder in FIG. 1.
Figure 5:
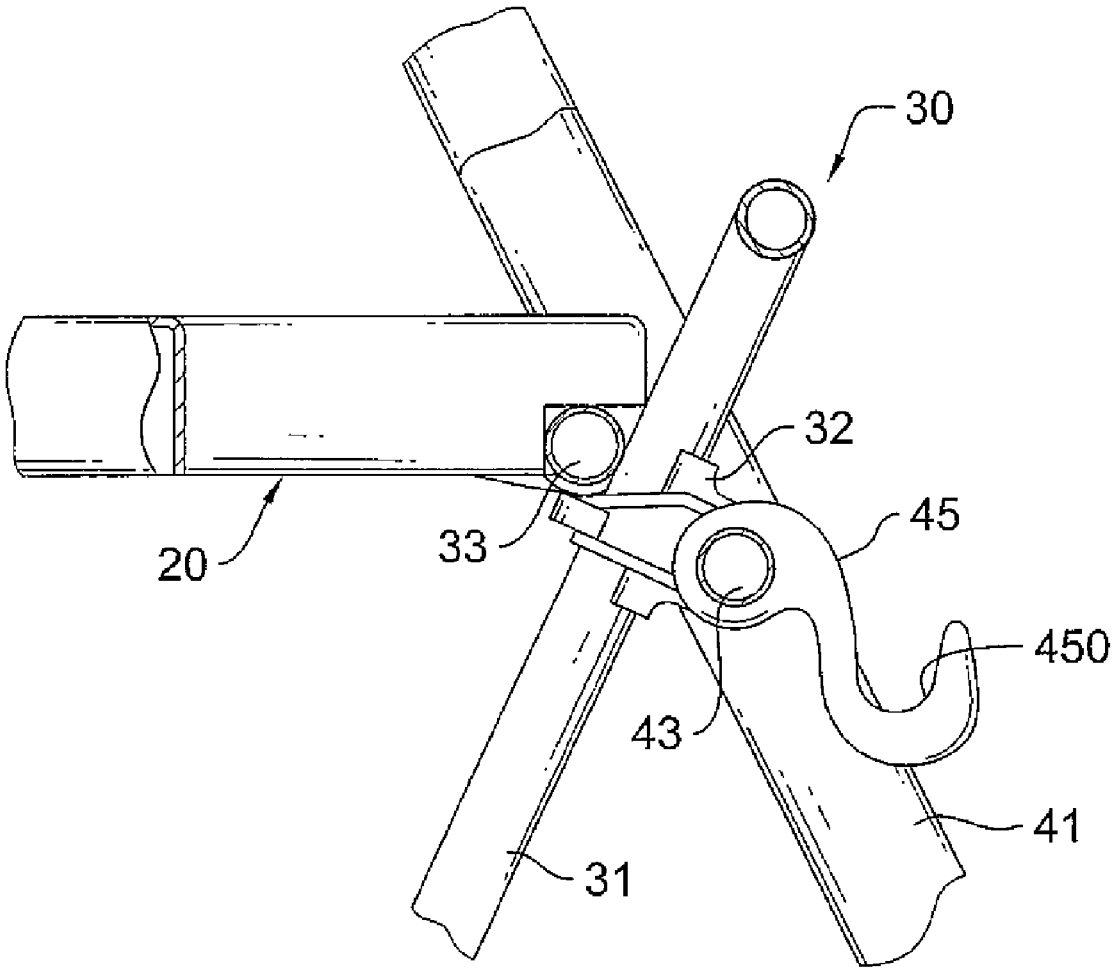
FIG. 5 is an enlarged operational side view of the stepladder in FIG. 4, shown with an unlocked crossbeam.

With further reference to FIGS. 4 and 5, the pivot pins (33) are mounted transversely between the bars (31), and one of the pivot pins (33) is selectively hooked by the hook (450) of the lock (45) of the rear frame (40) to lock the stepladder in an extended configuration.

The steps (20) are pivotally mounted respectively on the pivot pins (33) of the bracket (30) and are pivotally mounted respectively on the rungs (13) of the front frame (10). Each step (20) may have a rear end (22), a front end (21), a bottom and a notch (211).

The rear end (22) is mounted pivotally on one pivot pin (33) of the bracket (30).

The notch (211) is defined in the bottom adjacent to the front end (21) and is engaged rotatably with one rung (13) of the front frame (10).

Figure 6:
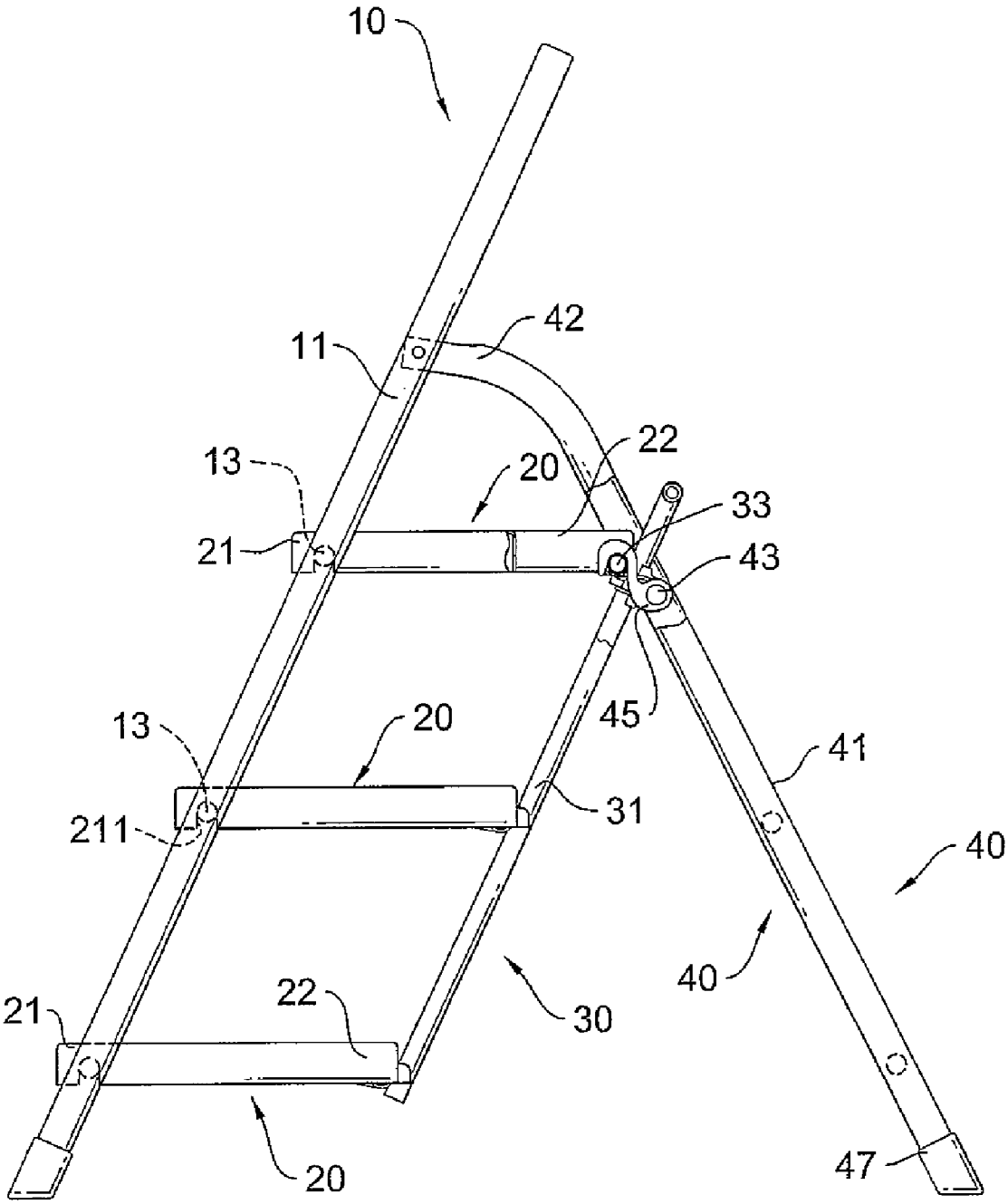
FIG. 6 is a side view in partial section of the stepladder in FIG. 1.

With further reference to FIG. 6, in the extended configuration, the notches (211) of the steps (20) are engaged respectively with the rungs (13) of the front frame (10).

Figure 7:
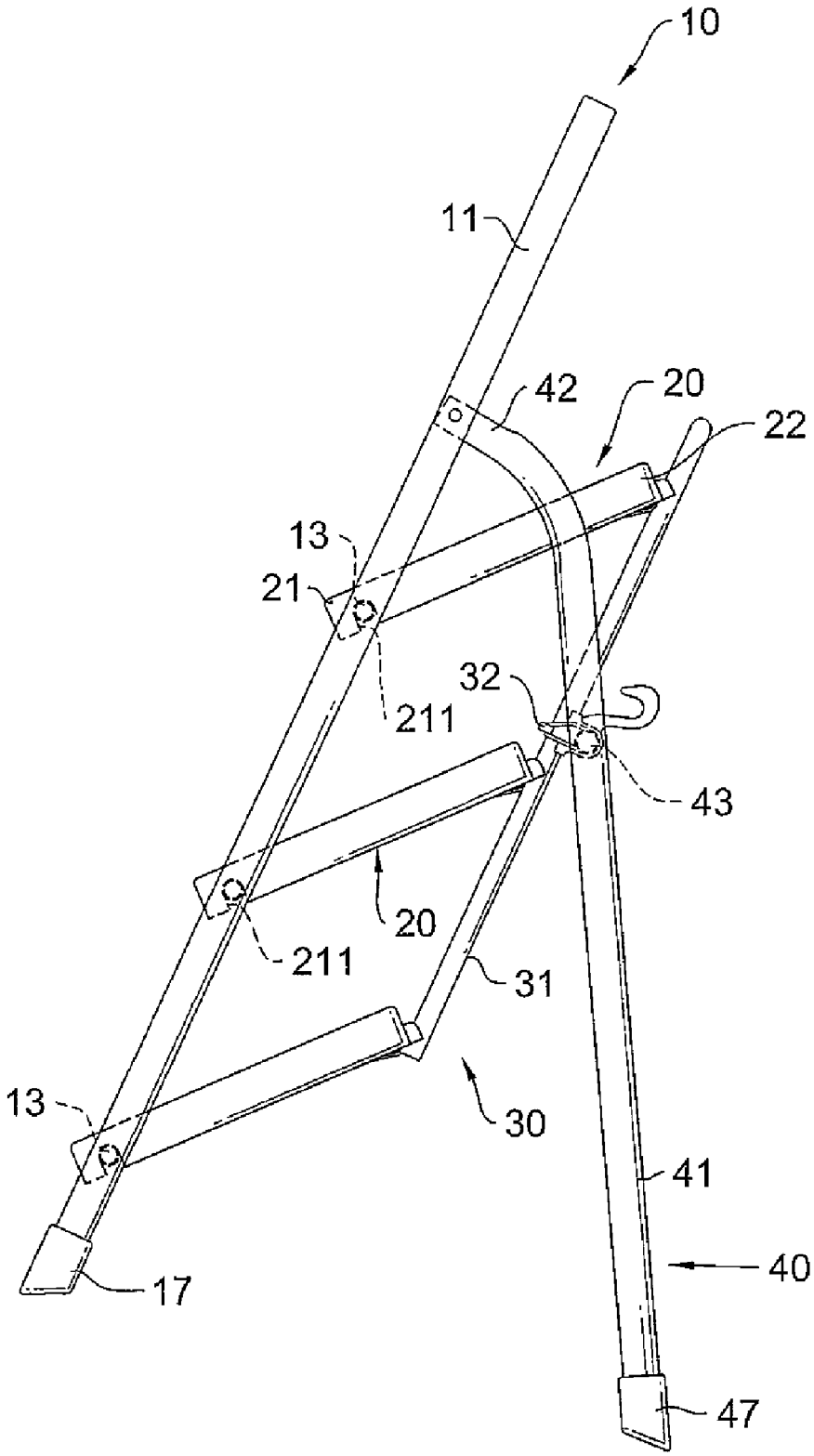
FIG. 7 is an operational side view of the stepladder in FIG. 1, shown folded halfway.
Figure 8:
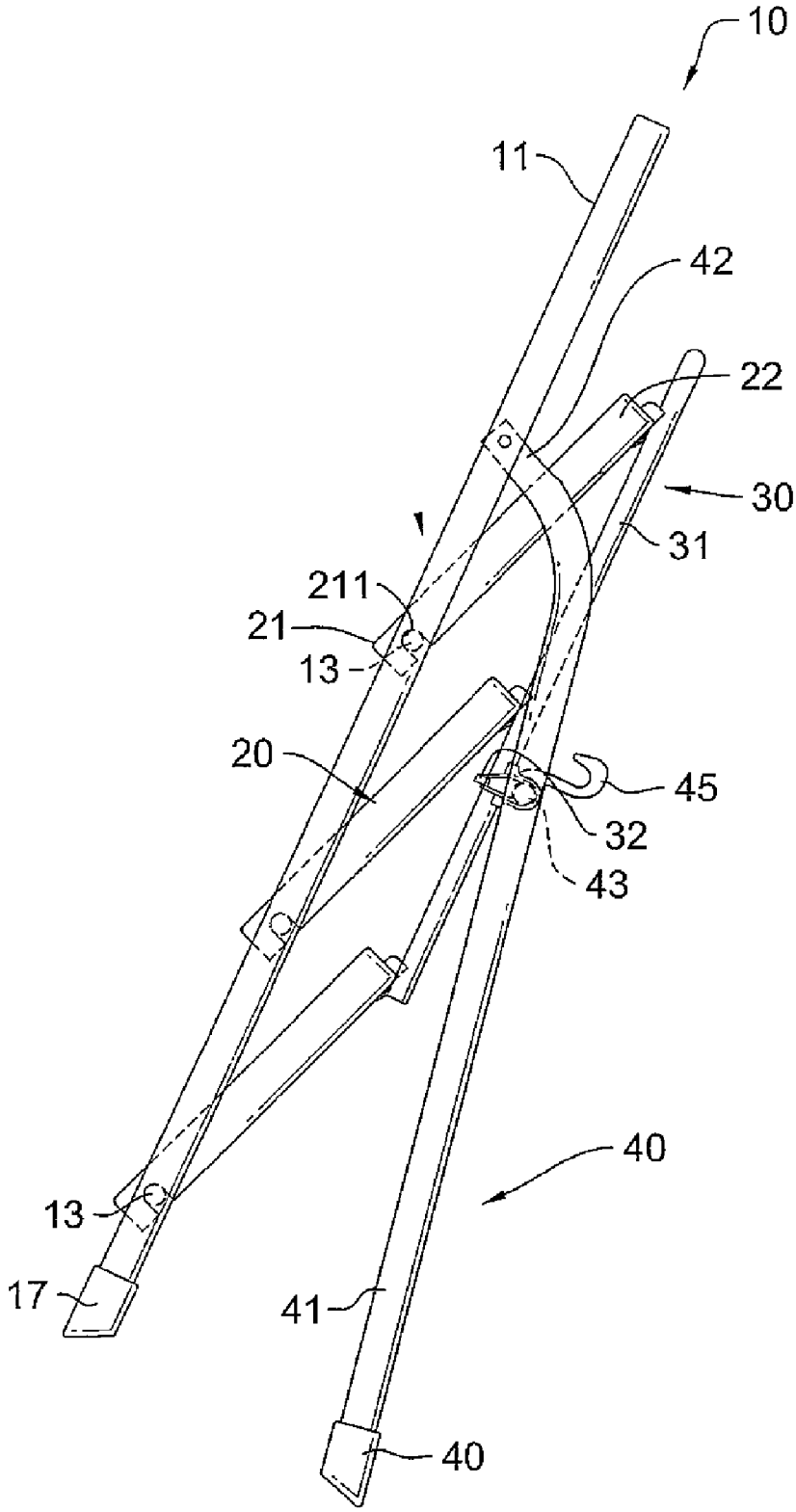
FIG. 8 is an operational side view of the stepladder in FIG. 7, shown folded halfway with steps disengaged from the front frame.

With further reference to FIGS. 7 and 8, to fold the stepladder, the lock (45) is disengaged from and releases the pivot pin (33) of the bracket (30) so that the rear frame (40) pivots relative to the front frame (10). When the ladder folds, the bracket (30) pivots on the crossbeam (43) of the rear frame (40), and the bars (31) of the bracket (30) slide relative to the pivot slides (32) on the crossbeam (43). The steps (20) pivot down relative to the bracket (30) and pivot up relative to the front frame (10).

Figure 9:
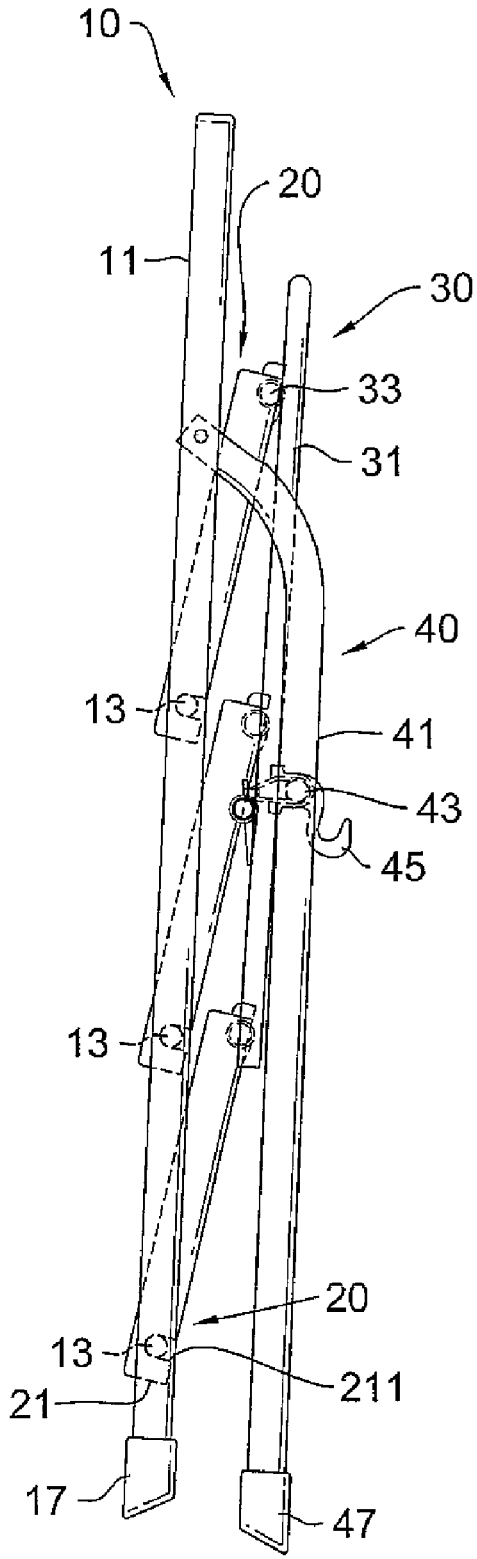
FIG. 9 is an operational side view of the stepladder in FIG. 8 shown completely folded.

With further reference to FIG. 9, to completely fold the stepladder, the front side rails (11) of the front frame (10) draw close to the rear side rails (41) of the rear frame (40), and the steps (20) pivot down and draw close to the bars (31) of the bracket (30).

Because the stepladder has the lock (45) hooking one pivot pin (33) of the bracket (30), the stepladder is stably locked in the extended configuration without inadvertently folding and collapsing so a user knows when the stepladder is in the extended configuration to safely stand on the steps without jolting or sudden opening which could cause injury.

Even though numerous characteristics and advantages of the present invention have been set forth in the foregoing description, together with details of the structure and function of the invention, the disclosure is illustrative only. Changes may be made in the details, especially in matters of shape, size, and arrangement of parts, within the principles of the invention to the full extent indicated by the broad general meaning of the terms in which the appended claims are expressed.

What is claimed is:

1. A stepladder comprising:

a front frame having two front side rails being parallel to each other and each front side rail having a bottom end; and multiple rungs mounted transversely between the front side rails at intervals;

a rear frame connected pivotally to the front frame and having two rear side rails corresponding respectively to the front side rails, the two rear side rails being parallel to each other and each rear side rail having a top end mounted pivotally on a corresponding front side rail; and a bottom end;

a crossbeam mounted transversely between the rear side rails; and a lock mounted pivotally on the crossbeam and having a hook formed on the lock;

a bracket connected pivotally and slidably to the rear frame and having two bars;

two pivot slides directly mounted on and respectively slidable with respect to the bars of the bracket and directly mounted pivotally on the crossbeam of the rear frame; and multiple pivot pins mounted transversely and directly between the bars, wherein one of the pivot pins is capable of being hooked by the hook of the lock of the rear frame; and multiple steps pivotally mounted respectively on the pivot pins of the bracket and pivotally mounted respectively on the rungs of the front frame.

2. The stepladder as claimed in claim 1, wherein each step has a rear end mounted pivotally on one of the pivot pins of the bracket;

a front end;

a bottom; and a notch defined in the bottom adjacent to the front end and engaged rotatably with one rung of the front frame.

3. The stepladder as claimed in claim 2, wherein the rear frame further has multiple supporting beams mounted between the rear side rails.

* * * * *